US010364580B1

(12) United States Patent
Bonachea Ruiz

(10) Patent No.: US 10,364,580 B1
(45) Date of Patent: Jul. 30, 2019

(54) GROUT INSTALLATION APPARATUS

(71) Applicant: Rudy Ammed Bonachea Ruiz, Miami, FL (US)

(72) Inventor: Rudy Ammed Bonachea Ruiz, Miami, FL (US)

( * ) Notice: Subject to any disclaimer, the term of this patent is extended or adjusted under 35 U.S.C. 154(b) by 87 days.

(21) Appl. No.: 15/176,852

(22) Filed: Jun. 8, 2016

(51) Int. Cl.
*B05C 11/10* (2006.01)
*E04F 21/165* (2006.01)

(52) U.S. Cl.
CPC ..... *E04F 21/1652* (2013.01); *B05C 11/1039* (2013.01); *E04F 21/165* (2013.01)

(58) Field of Classification Search
CPC .... B05C 11/1039; E04F 21/20; E04F 21/165; E04F 21/1652
See application file for complete search history.

(56) References Cited

U.S. PATENT DOCUMENTS 2,578,080 A * 12/1951 Middlestadt ..... E01C 23/098 222/131
3,130,652 A * 4/1964 Newton, Jr. ..... E01C 23/098 404/107
4,781,556 A * 11/1988 Paul ..... E04F 21/165 404/107
4,865,782 A * 9/1989 Paul ..... E01C 23/098 264/37.19
5,080,525 A * 1/1992 Bricher ..... E01C 19/187 118/108
5,807,022 A * 9/1998 McCleary ..... E04F 21/20 404/101
6,260,743 B1 * 7/2001 Mazzenga ..... E04F 21/165 118/313
6,382,922 B1 * 5/2002 Lewis ..... E04F 21/08 417/199.1
6,484,782 B1 * 11/2002 Lewis ..... E04F 21/08 156/577
7,614,813 B1 * 11/2009 Yande ..... B05C 17/00589 401/131
9,050,625 B1 * 6/2015 Bonachea Ruiz ..... B05D 3/12
9,234,359 B2 * 1/2016 Bourelle ..... E04F 21/162
2009/0294489 A1 * 12/2009 Keohan ..... E04F 21/165 222/611.2

* cited by examiner

*Primary Examiner* — David P Angwin
*Assistant Examiner* — Bradley S Oliver
(74) *Attorney, Agent, or Firm* — H. John Rizvi; The Patent Professor

(57) ABSTRACT

A grout installation apparatus having a grout applying member and a grout removal member rearward of the grout applying member. The grout applying member includes a grout tank for storing grout, and a grout dispensing head which rests against an area of a tiled surface, confines said area and applies grout to the confined area to efficiently push grout into spaces between tiles. The grout applying member can include a user-operable piston to push the grout from the grout tank to the grout dispensing head. The grout dispensing head can include a rear squeegee for scraping and sweeping excess grout forward from the confined area of the tiled surface. The grout removal member wipes excess grout from the tile surface.

15 Claims, 13 Drawing Sheets

208
234
231
232
230
241
202
204
212
213
280
220
290
133
290a
205
292
224
223
278
226
222a, 226a
203
207
222
225
225a
200
220
205
294
294a
133
288

129
131
130
298

129
131
130
299

GROUT INSTALLATION APPARATUS

FIELD OF THE INVENTION

The present invention relates generally to an apparatus which applies grout material between tiles and removes excess grout left on the surface of the tiles after application of the grout. More particularly, the invention is directed to a grout installation apparatus and method for using the apparatus to apply grout into spaces between tiles at a speed that is much faster than can be accomplished by manual methods used in the art, with the apparatus also removing any excess grout left on the surface of the tiles after upstream application thereof.

BACKGROUND OF THE INVENTION

Tiles are typically held in place by cement, also known as mud, or other suitable adhesives, such as epoxy, mastic, and the like. Grout is a non-adhesive material that is applied between tiles to fill voids between adjacent tiles. Grout typically comprises a mixture of water, cement, sand, and may further include a color tint, and/or fine gravel. It is applied as a thick liquid and hardens over time, much like mortar. Grout is not flexible, and cannot expand and contract with changing temperatures.

To allow sufficient curing time for the adhesive, grout is usually applied at least fourteen to sixteen hours after the tiles have been set.

Excess grout must be removed as soon as application thereof is completed, as it is very difficult to remove excess grout from the surface of the tiles once it has cured. The most common procedure used to remove such excess grout from the surface of the tiles is to manually sponge off the excess material with a wet sponge; a procedure which is labor intensive and time consuming.

Other procedures and tools are known for use in removing excess grout from the surface of floor tiles. A common flat head screwdriver has also been used to scrape grout from tile surfaces. However, this method has drawbacks. Due to the small flat area provided at the tip of the conventional screwdriver, only a small amount of excess grout can be removed at a time.

Another tool in common use has a handle and stem resembling those of a screwdriver, but which terminates at its distal end with a metallic triangularly shaped scraper head. The terminal edge of the blade and corners of the triangle have utility in removing cement.

Another tool known as a grout/caulk packer is used in the manual process to form a concavity along the linear extent of the grout or caulk via a spherical member mounted at a distal end of a handle of the packer.

Another complex manual device used to remove excess grout comprises a wide blade adapted to remove excess grout and caulk, a four-armed cement remover and grout joint spacer, a spherical grout packer and a V-shaped grout and caulk profiler. These structures are adapted to be secured to a hollow handle of the device in varying combinations.

Another device includes a tile adhesive removal system having a handle provided with one or more removable tips. A properly-sized tip is selected for a particular channel width, and is removably attached to the handle. The tip removes any excess adhesive from the channel between tiles, and is then cleaned for use with the next tile. The removal system may include an orienting element, so that the tip is not inserted upside down.

Also, a brush for a rotary floor machine specially adapted to clean grout from tile surfaces has been proposed. The brush includes a disk having a plurality of bores arranged into a plurality of rings disposed about one face of the disk. Each ring defines an arcuate pattern of alternating first and second bores, with the first bores angled radially inwardly and the second bores angled radially outwardly. Tufts of bristles disposed within the first and second bores thus form areas of overlapping bristles.

Even though the above defined devices for applying grout to tiles or for cleaning grout from tile surfaces exist, a single-labor and time-saving grout installation and tile surface cleaning apparatus and method of use are still desired.

SUMMARY OF THE INVENTION

This invention is directed to a grout installation apparatus having a grout applying member and a grout removal member rearward of the grout applying member. The grout applying member includes a grout tank for storing grout, and a grout dispensing head which rests against an area of a tiled surface, confines said area and applies grout to the confined area to efficiently push grout into spaces between tiles. The grout applying member can include a user-operable piston to push the grout from the grout tank to the grout dispensing head. The grout dispensing head can include a rear squeegee for scraping and sweeping excess grout forward from the confined area of the tiled surface. The grout removal member wipes excess grout from the tile surface.

In a first implementation of the invention, a grout installation system includes an apparatus having a grout applying member for applying grout to spaces between tiles comprised in a tiled area. The grout applying member includes a grout tank having an internal space for storing grout, and a grout dispensing head having an internal space in communication with the internal space of the grout tank for receiving grout therefrom. The apparatus further includes a grout removal member arranged rearward of the grout applying member, the grout removal member operable to remove grout from an outer surface of the tiles. The apparatus is operable to adopt a working position in which an outer edge of the grout dispensing head rests against the outer surface of the tiles, and in which the outer edge of the grout dispensing head defines a closed and planar perimeter encircling and delimiting an end opening of the grout dispensing head. The end opening which is formed in the working position is in communication with the internal space of the grout dispensing head for receiving grout from the grout tank and dispensing said grout through the end opening to a portion of the tiled area delimited by the perimeter.

These and other aspects, features, and advantages of the present invention will become more readily apparent from the attached drawings and the detailed description of the preferred embodiment, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the various views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
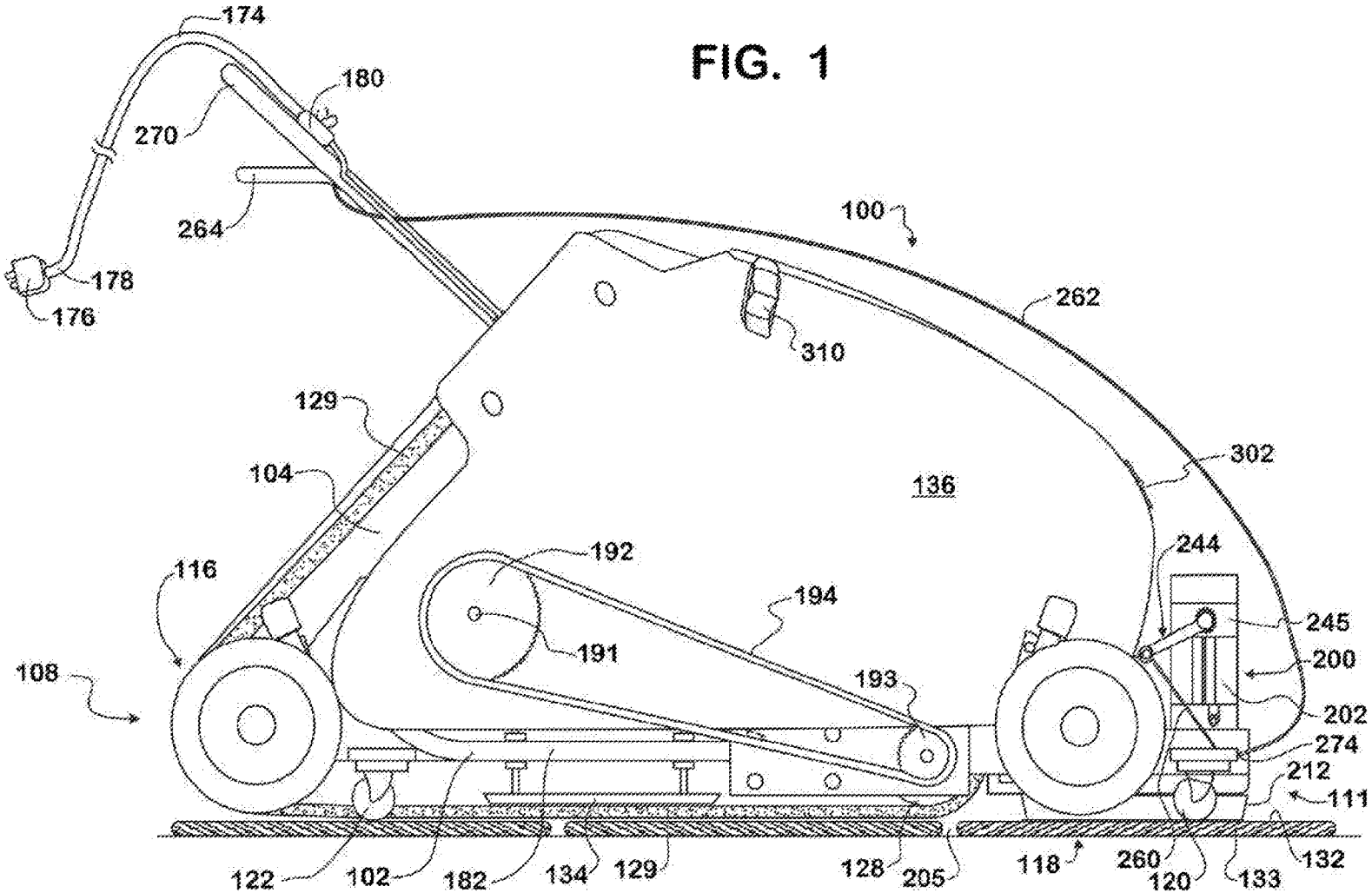
FIG. 1 is a side elevation view of the grout installation apparatus made in accordance with the teachings of the present invention showing the apparatus configured for use in its work environment.
Figure 2:
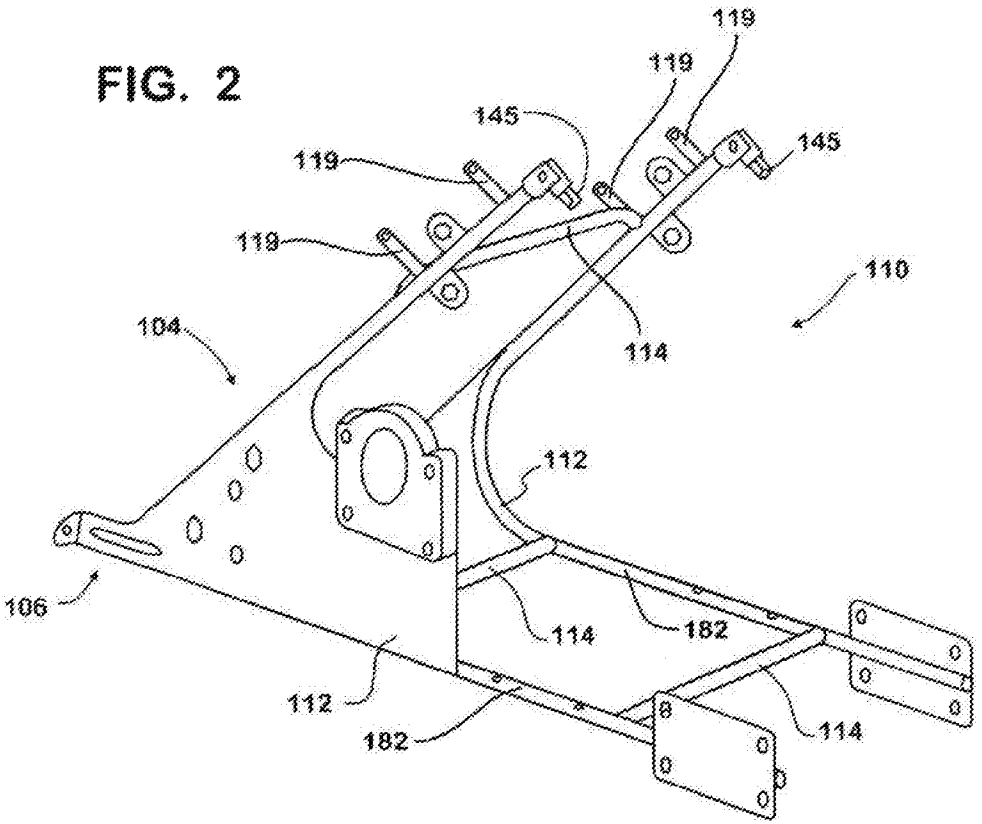
FIG. 2 is an isometric view of a framework mounted on a chassis of the apparatus, which is suitably configured to engage various structures of the apparatus thereon and thereto.

As illustrated throughout the figures, the invention is directed to a grout installation apparatus 100 and its method of use. Beginning with a description of the apparatus 100, it is seen to includes a bent tube chassis 102 upon which various structures thereof are engaged through provision of a framework 104 (FIG. 2) mounted on the chassis 102. The framework 104, as shown in FIG. 2, is in the form of a V which is laid on its side, with a tip 106 of the V being positioned toward a rear 108 (FIG. 1) of the apparatus 100 and an open end 110 thereof being positioned toward a front 111 (FIG. 1) of the apparatus 100. The framework 104 is seen to comprise two parallel, mirror image sidewalls 112 linked together by a plurality of cross members 114, the framework 104 to be defined in greater detail herein below.

Figure 3:
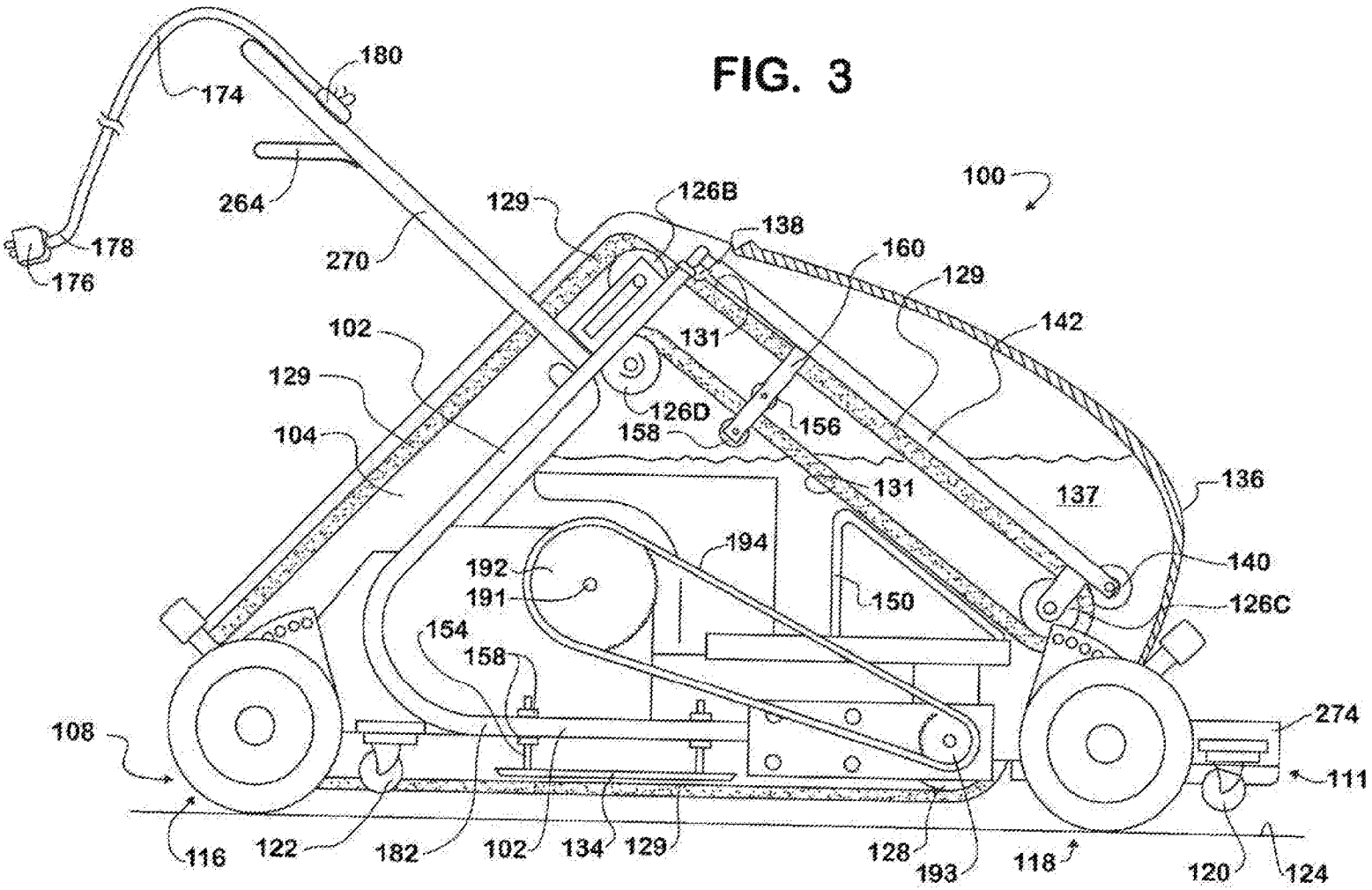
FIG. 3 is a partially sectioned side elevation view similar to that of FIG. 1 wherein the apparatus is shown configured for transport and wherein portions are removed to show the interior elements of the apparatus.

Returning now to FIG. 1, also mounted to chassis 102, are two sets of adjustable transport wheels 116 and 118. The set of wheels 116 mounted at the rear 108 of the apparatus 100 are larger than the set of wheels 118 mounted at the front 111 of the apparatus, the sets of wheels 116 and 118 being used for transport of the apparatus 100 to its intended location of use, as best illustrated in FIG. 3. The position of the wheels 116 and 118 relative to the chassis 102 and the attached framework 104 can be selectively adjusted. The apparatus 100 can adopt a transport position and a work position, shown respectively in FIGS. 3 and 1. In the transport position of FIG. 3, the wheels 116 and 118 are adjusted to a lowered position relative to the chassis 102 and framework 104, so that the wheels 116 and 118 rest on a surface or ground 124 and the apparatus 100 is rollingly transportable by the wheels 116 and 118 rolling on the ground 124. In the work position of FIG. 1, instead, the wheels 116 and 118 are adjusted to an elevated position relative to the chassis 102 and framework 104, two sets of auxiliary wheels 120 and 122 rest on a surface or ground (e.g. a top our outer surface 132 of tiles 133) while the wheels 116, 118 remain in the air, as shown. The two sets of auxiliary wheels 120 and 122 are mounted to the framework 104 toward the front 111 and the rear 108, respectively, of the apparatus 100.

Figure 5:
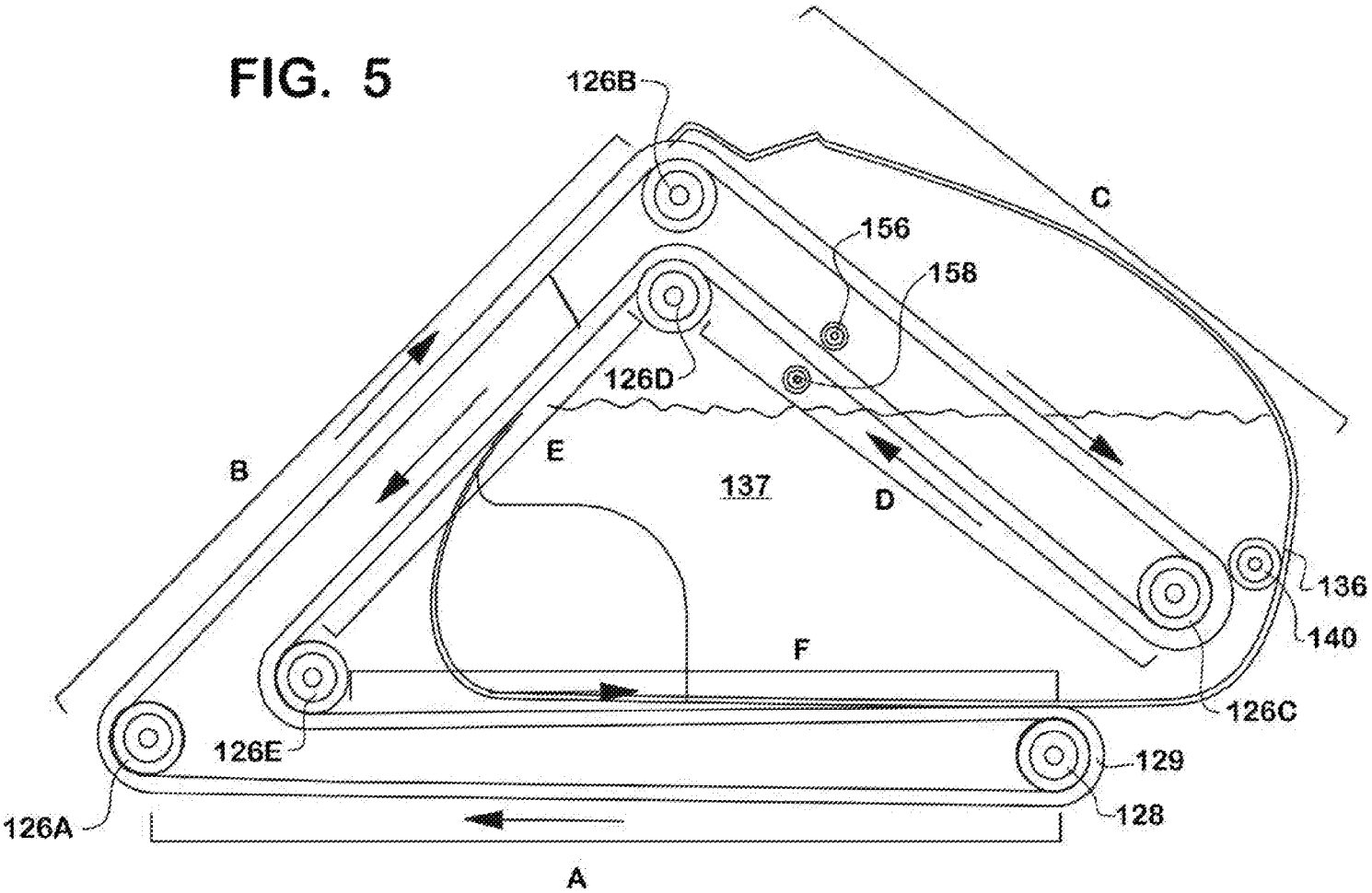
FIG. 5 is side elevation view showing flights of a continuous belt of the apparatus.
Figures 11, 12, 13:
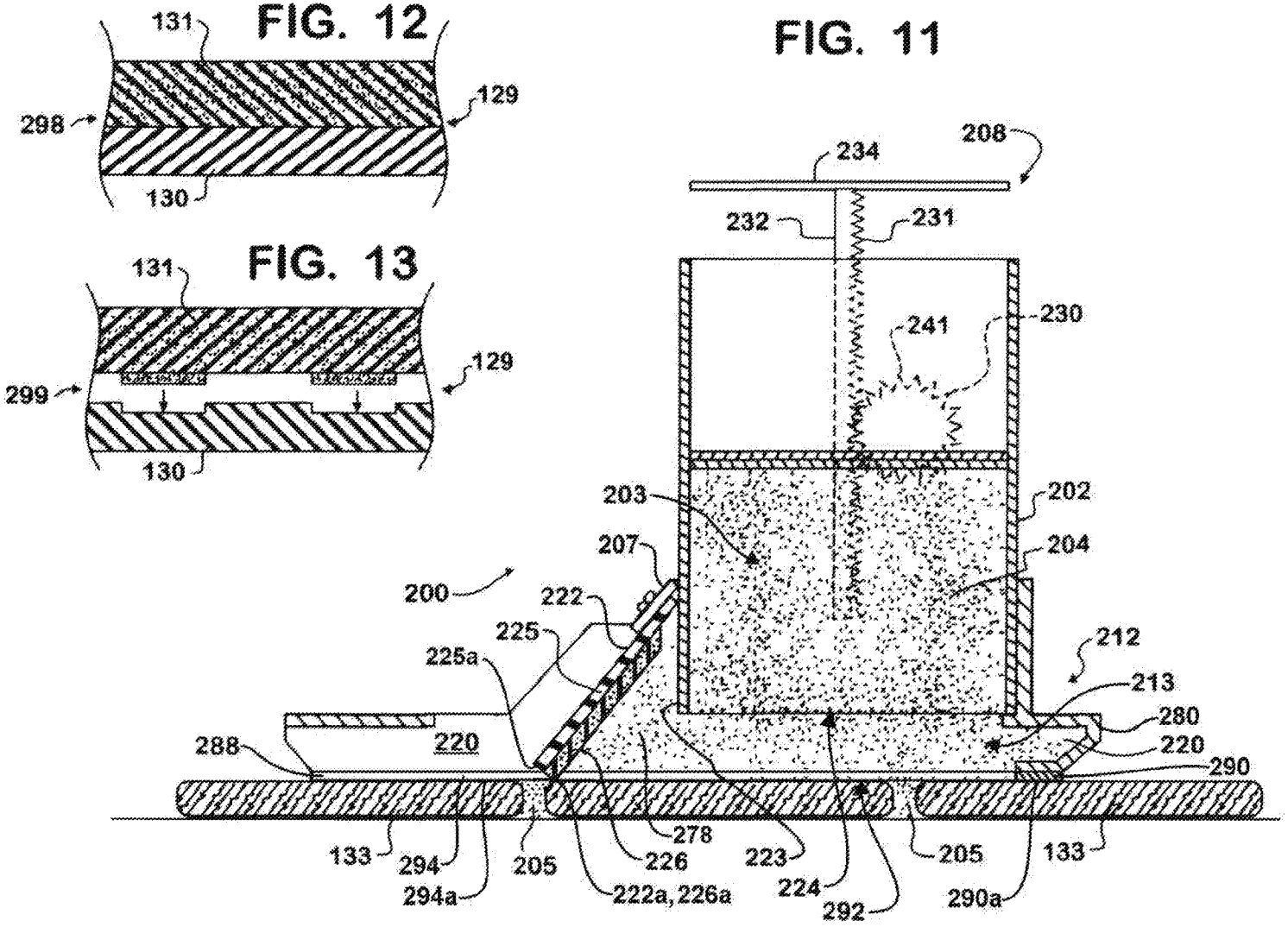
FIG. 11 is a cross sectional view through the grout applicator showing how same is functional in applying grout.
FIG. 12 is an enlarged partial cross sectional view of the continuous belt showing same to comprise a supporting layer and a sponge layer attached thereto, such as by a suitable adhesive.
FIG. 13 is a partial cross section of the continuous belt showing the sponge layer attached to the supporting layer with dense hook and loop tape.

Mounted also to the framework 104, in a desired pattern, either directly or indirectly, are a plurality of free rollers 126A, 126B, 126C, 126D, and 126E and one driven roller 128, as best illustrated in FIGS. 3 and 5. A continuous grout removing belt 129 is mounted about the rollers 126A-E and 128, and is used in contacting the surface 132 of the tiles 133 therebeneath to sponge excess grout from the surface 132 of the tiles 133 after grout 204 (FIG. 11) has been appropriately applied with the apparatus 100. The belt 129 is made of a carrier layer 130, preferably made of rubber, over which and to which a spongy layer 131 is suitably attached. The manner in which to create a continuous belt is known and any suitable method may be utilized here. For instance, the illustration of FIG. 12 shows the carrier layer 130 suitably engaged to the spongy layer 131 by an adhesive 298, which is preferably not affected by water. In another example, the illustration of FIG. 13 shows the carrier layer 130 and spongy layer 131 engaged by other suitable means, such as by the use of a suitable hook and loop connection means 299 between the carrier and spongy layers 130 and 131. These various embodiments are merely exemplary and should not be construed as limiting.

As best shown in FIG. 5, the belt 129 is configured about the rollers 126A-E and 128 to have six flights, labeled A, B, C, D, E and F, respectively. Flight A is the bottom most flight; the belt 129 travels horizontally along flight A, about driven roller 128 and free roller 126A, and is pressed against the underlying surface 132 of the tiles 133 by a compression platen or plate 134, shown in greater detail in FIG. 8. As will be explained in more detail hereinafter, the vertical position of the compression plate 134 is preferably adjustable, allowing to adjust the downward pressure applied by the compression plate 134 on flight A of the belt 129. With continued reference to FIG. 5, flight A travels rearwardly and then turns and takes flight B, a rearmost flight of the belt 129 which is angled upwardly and forwardly, traveling between free rollers 126A and 126B.

The next flight of the belt 129, flight C, is directed downwardly and forwardly into a wash water tank 136 filled to an appropriate height with wash water 137, this flight C being carried by and between rollers 126B and 126C. It will be understood that the wash water tank 136 seats upon and is supported by the cross members 114, in an area between the mirror image sidewalls 112 of the framework 104. The wash water tank 136 is engaged to the framework 104 by passing suitable connectors (not shown) through openings 117 in end flanges 115 thereof, shown in FIG. 4, and corresponding openings 119 in the framework 104, shown in FIG. 2. The wash water tank 136 is provided with a movable cover 300 that can be opened to allow filling the wash water tank 136 with water prior to using the apparatus 100. The cover 300 depicted herein pivots about hinges 302 positioned along a top surface 304 of the wash water tank 136 in a manner to allow for containment of the wash water 137 therein to a point just below where the hinges 302 are positioned. Also, to maintain the wash water 137 within the wash water tank 136, the cover 300 can be latched to the wash water tank 136 by latches 310, one to either side of the wash water tank 136.

Figure 6:
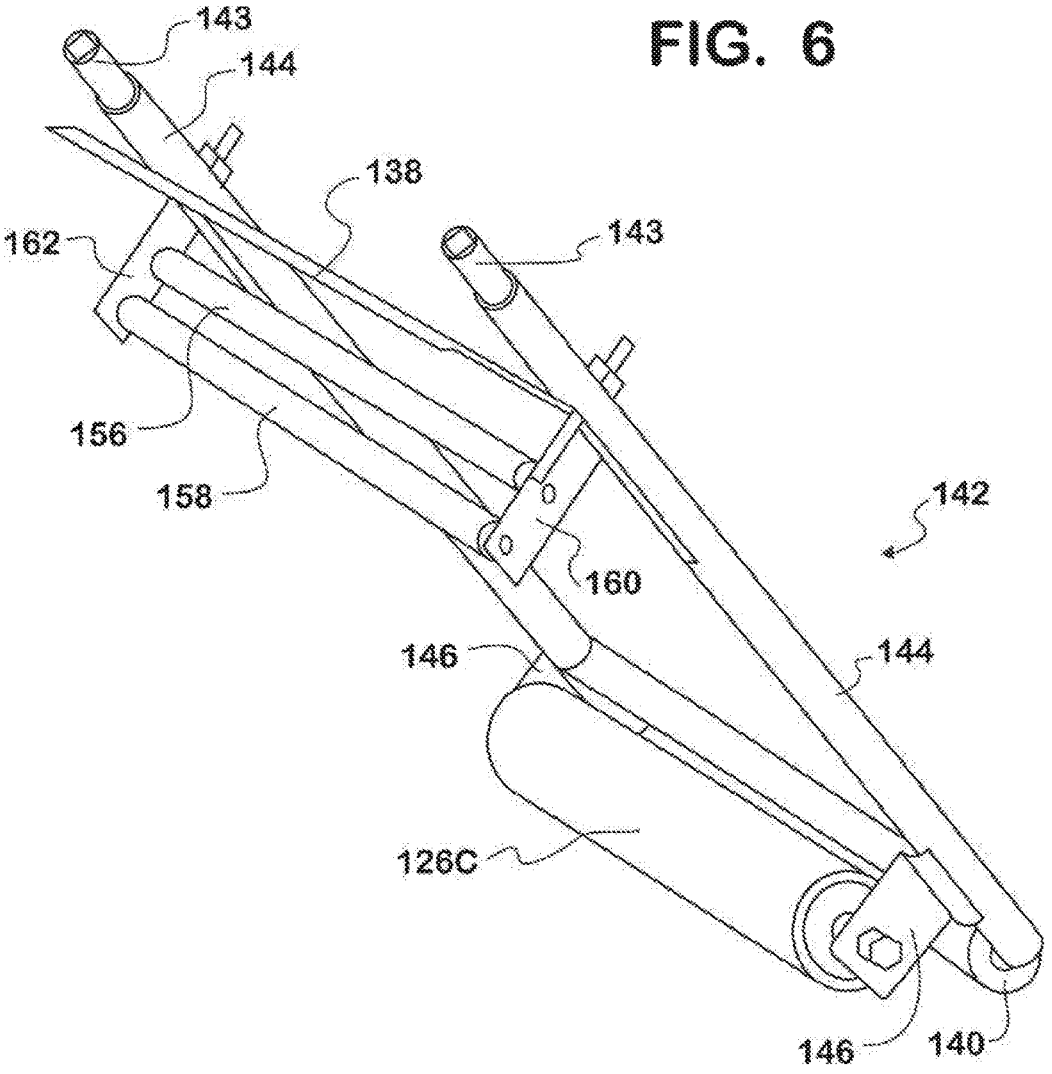
FIG. 6 is an isometric view of a belt cleaning assembly of the apparatus.

With reference again to FIG. 5, as the belt 129 moves along flight C, at or near a forward terminus of this flight C and within the wash water 137 in the wash water tank 136, the belt 129 is squeezed against roller 126C by a compression roller 140. As shown in FIG. 6, both the free roller 126C and the compression roller 140 are mounted to a separate frame member 142, as is a scraper 138. The frame member 142 is positioned along and above flight C, such that the compression roller 140 thereof compresses the belt 129 between roller 126C and itself to clean the belt 129 as it passes between the rollers 140, 126C. The frame member 142 engages framework 104 at free ends 143 of side frame sections 144 thereof which are received on and supported by tabs 145 of the framework 104 (FIG. 2). It will further be seen in FIG. 6 that compression roller 140 attaches directly to the frame member 142 while roller 126C is attached to the frame member 142 via end flanges 146.

Figure 4:
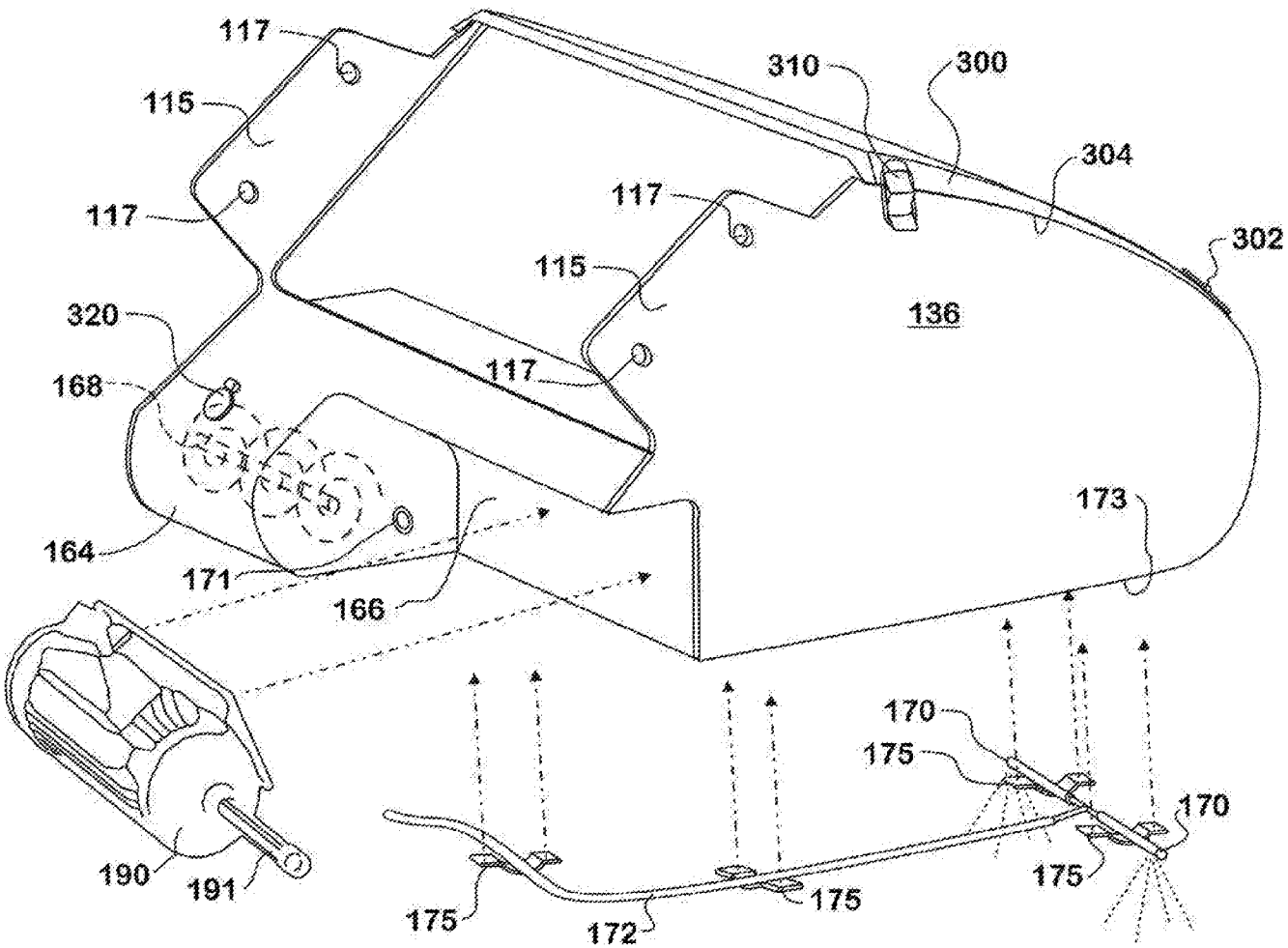
FIG. 4 is an exploded isometric view showing a wash water tank of the apparatus, to which is piggybacked a clean water tank, and showing a clean water dispensing system used to apply a spray of water to a continuous belt of the apparatus, and further showing where a motor of the device fits within a space defined alongside the clean water tank and to a rear of the wash water tank.
Figure 7:
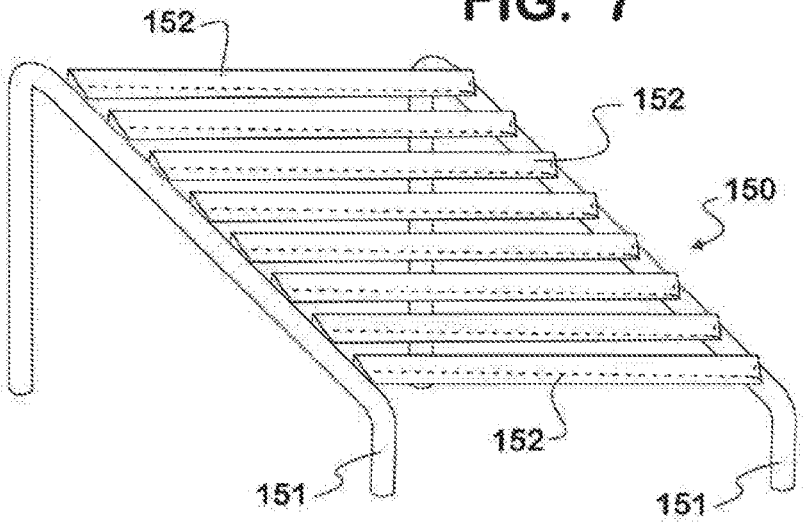
FIG. 7 is an isometric view of a belt scraping assembly of the apparatus.

As shown in FIG. 5, the next flight D of the belt 129 now turns upwardly and rearwardly out of the wash water tank 136 carried between rollers 126C and 126D. While traveling along flight D, the spongy layer 131 of the belt 129 passes across a second scraper 150, shown in FIG. 1 and best illustrated in FIG. 7; the scraper 150 is angled identical to flight D of the belt 129 and carries a plurality of parallel scraping elements or squeegees 152 which remove remaining grout on the spongy layer 131 of the belt 129, leaving the removed grout in the wash water tank 136. As shown in FIGS. 1 and 3, as the belt 129 exits the wash water 137 on its way up to roller 126D from roller 126C in the wash water tank 136, it is passed between a pair of cooperating compression rollers 156 and 158. As shown in FIG. 6, the compression rollers 156 and 158 are attached to the frame member 142 by end flanges 160 and 162. The compression rollers 156 and 158 are arranged at a position in which they compress the belt 129 above the level of the wash water 137 in the wash water tank 136, squeezing water from the spongy layer 131 of belt 129 back into the wash water tank 136. The carrier layer 130 is further scraped to remove excess water through a water scraper 138 shown in FIG. 6. As further shown in FIG. 5, the belt 129 then takes flight E carried between rollers 126D and 126E downwardly and rearwardly, behind and outside of the wash water tank 136. Next, flight F carries the belt 129 between free roller 126E and driven roller 128, forwardly. During this flight F of the belt 129, water is propelled from a fresh or clean water tank 164, shown in FIG. 4. The clean water tank 164 is mounted along a portion of a rear wall 166 of the wash water tank 136, and is provided with a fill port 320, such as a covered fill port which can be uncovered to allow filling the clean water tank 164 with fresh water. An internal turbine 168 is arranged within the clean water tank 164, shown in phantom in FIG. 4, for propelling and water from the clean water tank 164 to an outlet 171 of the clean water tank 164. A tubing 172 is connected to the outlet 171 and is suitably engaged to and along a bottom surface 173 of the wash water tank 136, such as by clips 175, as best illustrated in FIG. 4. The tubing 172 includes a plurality of spray nozzles 170 for spraying water propelled from the clean water tank 164 onto the belt 129 passing under the wash water tank 136. The turbine 168 constantly pumps clean water through the outlet 171, the tubing 172 and the nozzles 170, all of which are connected to one another in watertight manner. This fresh water spray from spray nozzles 170 ensures that the belt 129 is wet when it takes its next flight (flight A), to clean grout off the surface 132 of the tiles 133 therebeneath.

It will be understood, of course, that the apparatus 100 must be powered in order to be functional. This power may be provided, for instance and without limitation, by means of connection to an AC circuit, such as by an electrical power cord 174 having a plug 176 at a free end 178 thereof, as illustrated in FIG. 1, for engaging an electrical receptacle (not shown). The electrical power cord 174 engages an on/off switch 180, from which power is provided to the turbine 168 in the clean water tank 164 and to a motor 190 which drives the belt 129. The motor 190, as shown in FIG. 4, is suitably attached to the framework 104 (FIG. 2) and is seated behind the wash water tank 136 and to one side of the clean water tank 164. As shown in FIGS. 1 and 3, a drive axle 191 of the motor 190 rotates a drive gear 192 for driving the driven roller 128 the belt 129. In some embodiments, a drive chain 194 extends from the drive gear 192 to a driving gear 193 of the driven roller 128 for driving the belt 129 through its various flights already defined.

Thus, an apparatus 100 is provided having a belt 129 which circulates about a set of rollers and cleans grout off a surface 132 of tiles 133 while pressed against the underlying surface 132 of the tiles 133 by a compression plate 134. When the apparatus 100 is in the work position of FIG. 1, the compression plate 134, which depends from and is engaged to the chassis 102, presses against the belt 129 to maintain its position against the underlying surface 132 of the tiles 133 such that the spongy layer 131 of the belt 129 rubs against the surface 132 of the tiles 133 therebeneath to remove any grout on the surface 132 of the tiles 133. When the apparatus 100 is in the transport position of FIG. 3, instead, the compression plate 134 is elevated with respect to the work position, and the belt 129 is elevated and separated from the surface or ground 124 beneath the apparatus 100.

Figure 8:
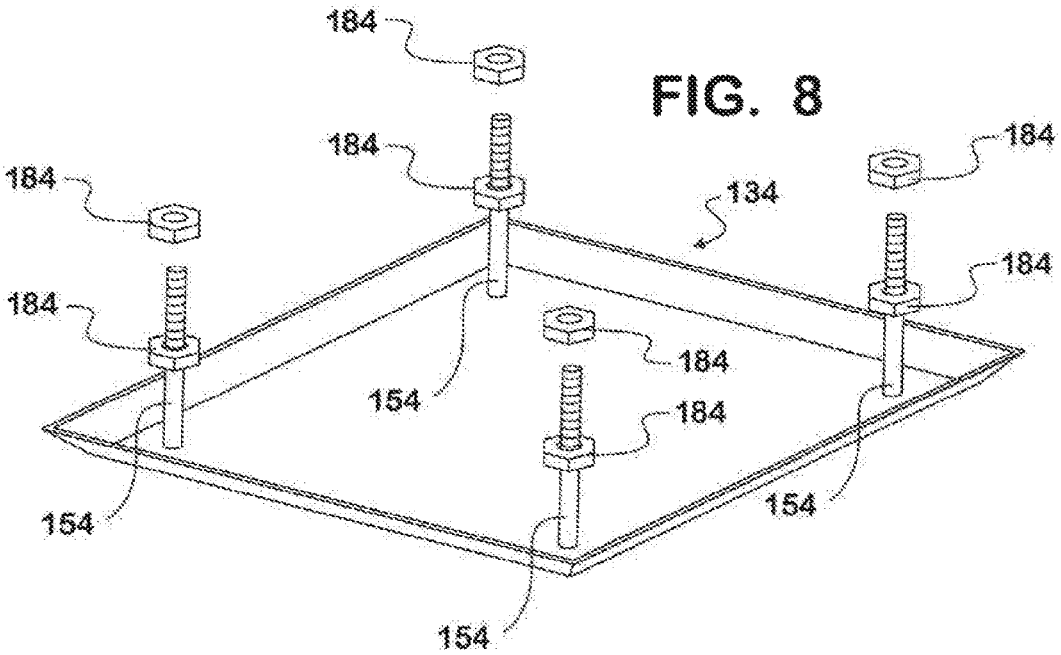
FIG. 8 is a partially exploded isometric view of a belt compression plate or platen which compresses the continuous belt against an underlying surface of the apparatus, the tile surface, when in work mode.

The illustration of FIG. 8 shows an enlarged perspective view of the compression plate 134. As mentioned heretofore, the vertical position of the compression plate 134 is preferably adjustable, allowing to adjust the downward pressure applied by the compression plate 134 on flight A of the belt 129. For this purpose, the compression plate 134 can be mounted along an underside of the chassis 102 of the apparatus 100, by means of partially threaded corner mounts 154 which extend through cooperating openings (not shown) in opposite bottom side rails 182 of the chassis 102. Desired relative vertical positioning of the compression plate 134 is assured by engagement of the bottom side rails 182 between two connectors 184 (e.g. pairs of nuts), positioned along each corner mount 154, the connectors 184 being positioned above and below the bottom side rails 182 of the chassis 102. The compression plate 134 preferably extends across the width of the belt 129 and, as mentioned heretofore, is positioned to ensure that the belt 129 is pressed against the underlying surface 132 when the apparatus 100 is in its work position, supported on the auxiliary wheels 120 and 122, as shown in FIG. 1. By means of the pressure applied against the belt 129 and thus the surface 132 of the tiles 133 therebeneath, a thorough removal of any excess grout remaining on the surface 132 of the tiles 133 after application of grout thereover by grout application system 200. Having the compression plate 134 vertically adjustable allows a user to adjust the downward pressure applied by the compression plate 134 on the belt 129. If the compression plate A is set to apply an adequate pressure, the fractioning of the rearward moving flight A of the belt 129 against the underlying surface 132 of the tiles 133 not only cleans the surface 132 but also propels the apparatus 100 forward.

Figure 9:
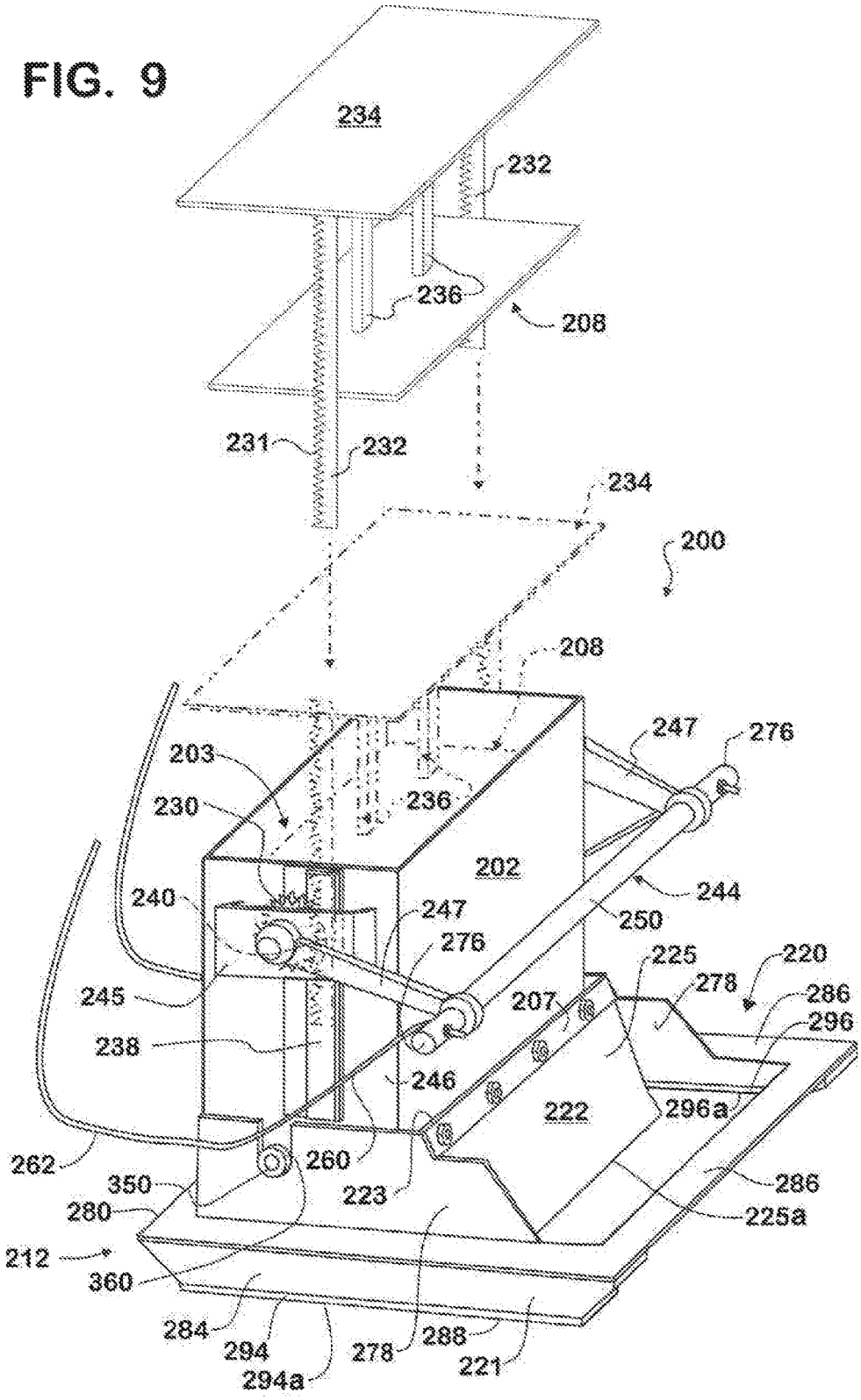
FIG. 9 is an isometric view of the grout applicator of the apparatus.
Figure 10:
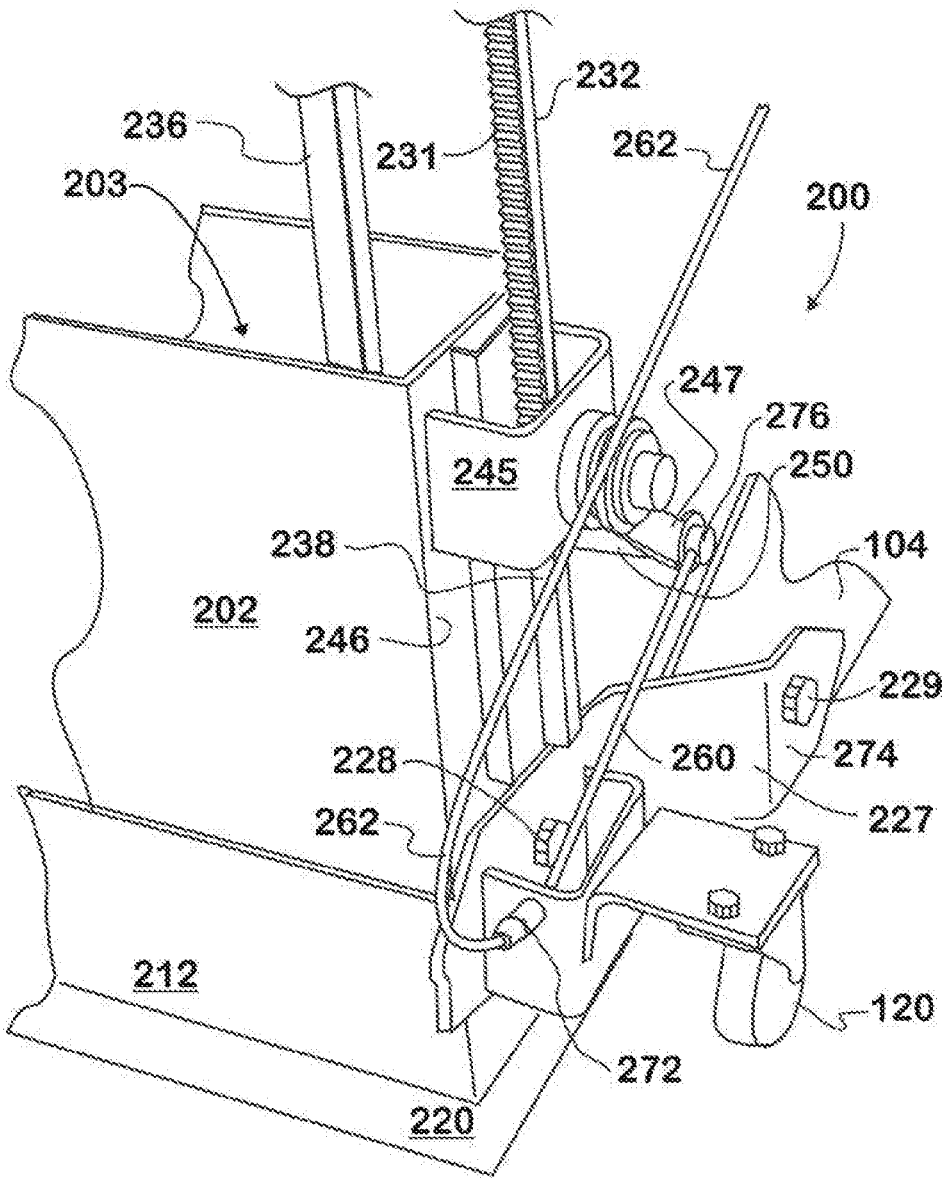
FIG. 10 is an isometric view of a portion of the grout applicator showing how same is engaged to the framework of the apparatus.

In addition to cleaning the grout from the surface 132 of the tiles 133 using cleaning flight A of belt 129, the apparatus 100 disclosed herein comprises a grout application system 200 which applies grout to the tiles. The grout application system 200 is arranged frontward or upstream relative to flight A of belt 129; i.e. cleaning of the tile surface 132 takes place at a position downstream, or rearward of the grout application system 200. The grout application system 200 is illustrated in FIGS. 9-11 and includes a grout tank 202 and a grout dispensing head 212, which are coupled to one another, and in turn carried by the framework 104 and the front auxiliary wheels 120. Specifically, as shown in FIG. 10, the grout tank 202 is engaged to one end of support flanges 227 to either side, which also carry the wheels 120 thereof, by means of securement structures such as bolts 228. An opposite end of the support flanges 227 are engaged to the framework 104 by bolts 229. The grout tank 202 comprises an internal space 203 that is initially loaded with grout 204, and selectively delivers grout 204 from the internal space 203 into an internal space 213 of the grout dispensing head 212. The grout dispensing head 212 then applies the grout 204 onto the tiles 133 as will be explained in greater detail hereinafter.

The grout tank 202 includes a cooperating removable plunger or piston 208 which is positioned at least partially within the grout tank 202 and can move downward within the grout tank 202 to push the grout 204 down and out of grout tank 202 and into the spaces 205 between the tiles 133. In order to move the piston 208, the apparatus may include a user-operable mechanism which can be manual or automatic (e.g., electric). For instance and without limitation, a manually-operable mechanism is depicted herein, comprising ratchet gears 230 which engage with teeth 231 of toothed end edge flanges 232 provided on the piston 208. These toothed end flanges 232 attach to and depend from an upper plate 234 of the piston 208, which upper plate 234 is spaced above and suitably engaged to the piston 208, such as by rods 236. The toothed end edge flanges 232 slide into tracks 238 provided to either side of the grout tank 202. Each track 238 has an opening 240 therein, with the openings 240 to either side of the grout tank 202 mirroring each other. Extending into each opening 240 in each side track 238 are teeth 241 of a cooperating ratchet gear 230. As shown in FIG. 9, the ratchet gears 230 engage a common pivotable handle 244, the pivotable handle 244 being mounted pivotably onto end flanges 245 on corresponding opposite side walls 246 of the grout tank 202. When the pivotable handle 244 is pivoted, it moves the ratchet gears 230, which in turn pull the toothed end flanges 232 of the piston 208 downwardly, pushing grout 204 downwardly out of the grout tank 202 into the grout dispensing head 212. In some embodiments, the pivotable handle 244 can also be operated to move the ratchet gears 230 in an opposite direction, to pull the toothed end flanges 232 of the piston upwardly, and thus elevate the piston 208 (for instance, to remove the piston 208 and refill the grout tank 202). As shown, the handle 244 can comprise two sections 247, one adjacent each side wall 246 of the grout tank 202, the sections 247 being joined together by a cross rod 250; the opposite sections 247 act in unison, moving the piston 208 in a balanced way so that the piston 208 remains perpendicular to, and sealed to, the walls of the grout tank 202, and pushing grout 204 evenly out of the grout tank 202.

Operation of the pivotable handle 244 is accomplished through use of actuating wires or cables 260 which extend through casings 262 from a handle 270 of the apparatus 100, as best shown in FIG. 1, through a wire nut 272 attached to each support member 274 for the grout tank 202, which support members 274 engage the grout tank releasably to the framework 104 of the apparatus 100, as best illustrated in FIG. 10. From the wire nuts 272, each actuating cable 260 extends into a suitable connection with an end 276 of the cross rod 250 of the pivotable handle 244. When more grout 204 is required to be extruded from grout tank 202, an operator moves a pivotable lever 264 on the handle 270 of the apparatus 100 (FIG. 1) from which the actuating cables 260 extend; the pivotable lever 264 pulls on the actuating cables 260, which in turn pull and move the handle 244, causing actuation of the ratchet gears 230, pushing the piston 208 further into the grout tank 202, and delivering another dose of grout 204 into the grout dispensing head 212.

The grout dispensing head 212, best shown in FIGS. 9 and 11, is coupled to a bottom portion of the grout tank 202 in a sufficiently tight manner to prevent grout 204 from oozing from inside the grout tank 202 and grout dispensing head 212 through the coupling thereof. The internal space 213 of the grout dispensing head 212 is in fluid communication with the internal space 203 of the grout tank 202. In some embodiments, the grout tank 202 can be slid into an upper area of the grout dispensing head 212, with positioning tabs 350 on side wall 246 of the grout tank 202 seating within cooperating notches 360 provided in the grout dispensing head 212. The grout dispensing head 212 further includes a bottom frame 220 which rides on, and along, the surface 132 of the tiles 133. The bottom frame 220 includes a frame body 221 which, in the present embodiment, is rectangular and includes a front portion 280, a rear portion 282 and two opposite side portions 284, 286. The bottom frame 220 further includes a flexible layer 288 at a bottom side thereof, as shown in FIGS. 9 and 11. The flexible layer 288 is elastically-deformable (tending to recover its original non-deformed shape), and is preferably made of rubber foam, a spongy material made of rubber or plastic in the form of foam. The flexible layer 288 comprises a front portion 290 and side portions 294, 296 respectively arranged at the front portion 280 and side portions 284, 286. The front and side portions 290, 294, 296 of the flexible layer 288 comprise a respective bottom side 290*a*, 294*a*, 296*a*.

The grout dispensing head 212 further includes an angled, flexible wiper blade or squeegee 222 arranged rearwardly to the grout tank 202 and more particularly, rearwardly to a bottom opening 224 of the grout tank 202, shown in FIG. 11, through which the grout 204 is expelled from the grout tank 202 into the grout dispensing head 212. In some embodiments such as the present one, the angled squeegee 222 can extend from a trailing edge 223 of the grout tank 202. The squeegee 222 can comprise a flexible metal panel 225 attached to a flexible rubber panel 226. The squeegee 222 is flexible and elastically-deformable, tending to recover its original non-deformed shape. In some embodiments, the flexible metal panel 225 can be made of steel. The flexible rubber panel 226 in turn, can be made of rubber foam. The flexible metal panel 225 can be attached to a rear crossbeam 207 of the bottom frame 220 by at least one threaded fastener, bolt, riveted fastener, an adhesive, combinations thereof, or the like. In turn, the rubber panel 226 can be attached to the metal panel 225 by any one of the above attachment means or fasteners. The squeegee 222, and particularly the rubber panel 226, extends along a full width of the internal space 213 of the grout dispensing head 212 delimited between two sidewalls 278, and preferably from a top area of the internal space 213 to a bottom area of the internal space 213, in order to close and seal the internal space 213 at a rear end thereof. In the present embodiment, both the metal panel 225 and the rubber panel 226 extend along the full width of the squeegee 222 spanning from the opposite left and right sides of the squeegee 222, and also extend from a top area of the internal space 213 to a bottom end of the squeegee 222 arranged at a bottom area of the internal space 213.

In use, the apparatus 100 is set to the transport position of FIG. 3 (i.e. the position in which the bottom flight A of the belt 129, the grout dispensing head 212 and the auxiliary wheels 120, 122 do not rest on the ground and the apparatus 100 is instead supported by the transport wheels 116, 118). The apparatus 100, set to the transport position, is then moved to a location at which it is to apply grout 204 to a tiled area or floor. If not previously filled, the grout tank 202 is filled with grout 204 and then the piston 208 is positioned within the grout tank 202. Once the apparatus 100 is placed in the desired location, the user operates the apparatus 100 to switch to the working position of FIG. 1, in which the bottom flight A of the belt 129, the grout dispensing head 212 and the auxiliary wheels 120, 122 rest on the surface 132 of the tiles 133 and the transport wheels 116, 118 are in the air. In this working position, also shown in FIG. 11, the squeegee 222 is arranged such that a bottom or distal end 225*a* of the metal panel 225 is arranged higher than or elevated from a bottom or distal end 226*a* of the rubber panel 226, the distal end 226*a* of the rubber panel 226 thus providing a distal end 222*a* of the squeegee 222. In this working position, the bottom edges 290*a*, 294*a*, 296*a* of the front and side portions 280, 284, 286 of the flexible layer 288 at the bottom of the frame body 221 and the bottom or distal edge 222*a* of the squeegee 222 form an outer edge of the grout dispensing head 212. In this working position, in which the grout dispensing head 212 is resting on the outer surface 132 of the tiles 133, the outer edge of the grout dispensing head 212 formed by edges 290*a*, 294*a*, 296*a* and 222*a* forms a closed rectangular perimeter which is arranged on a plane (that of the outer surface 132). This closed rectangular perimeter encircles and delimits a bottom or end opening 292 of the grout dispensing head 212, shown in FIG. 11. This end opening 292 is communicated with the internal space 203 of the grout tank 202 for receiving grout 204 from the grout tank 202 and dispensing said grout 204 through the end opening 292.

The plug 176 of the electrical power cord 174 is then inserted into a socket and the apparatus 100 is turned on through activation of the on/off switch 180, turning on the motor 190 for moving the belt 129 and powering the turbine 168 in the clean water tank 164. The user then grasps the handle 270 of the apparatus 100 and presses down on the pivotable lever 264 thereof, actuating the ratchet gear 230 of the grout application system 200. The teeth 241 of the ratchet gears 230 acting in cooperating with the teeth 231 of toothed end flanges 232 of the piston 208 force the piston 208 to move downward, pushing grout 204 downward out of the grout tank 202 and into the grout dispensing head 212 towards the end opening 292. Because the rectangular outer edge of the grout dispensing head 212 formed by edges 290*a*, 294*a*, 296*a* and 222*a* rests against the outer surface 132 of the tiles 133, grout 204 is delivered through the end opening 292 to a limited rectangular portion of the outer surface 132 of the tiles 133, and is confined within said limited rectangular portion. This forces the grout 204 into the spaces 205 between the underlying tiles 133.

In addition, as the apparatus 100 moves forward (for instance as directed by the user) along the tiles 133, the squeegee 222 of the grout dispensing head 212 scrapes off a significant amount of the grout 204 on the surface 132 of the tiles 133 and sweeps the grout 204 forward while confining the grout 204 within the internal space 213 of the grout applying head 212 and within the rectangular outer edge of the grout dispensing head 212. The flexible layer 288 on the bottom side of the frame body 221 contributes to push the grout 204 into the spaces 205. In addition, the fact that the outer edge of the grout dispensing head 212 is formed by edges 290*a*, 294*a*, 296*a* and 222*a* of flexible and elastically-deformable components helps maintain the sealing against the surface 132 of the tiles 133 in the event of irregularities in the surface 132.

Thus, through provision of the limiting or containment grout dispensing head 212, the grout 204 is not allowed to flow about at will in any direction; instead, the grout dispensing head 212 seals an area of the surface 132 of the tiles 133, confines the grout 204 plunged from the grout tank 202 to said area, and scrapes and sweeps most of the grout 204 forward as the apparatus 100 moves forward, leaving the spaces 205 between the tiles 133 filled with grout 204. User operation of the piston allows the user to maintain the pressure exerted by the piston on the grout 204, contributing to force the grout 204 well into the spaces 205 between the tiles 233.

The scraping off by the squeegee 222 of the grout dispensing head 212 is then followed by contact of the continuous belt 129 of the apparatus 100, following behind the grout application system 200, with the surface 132 of the tiles 133 over which the belt 129 travels, removing any grout remaining on the surface 132 (but not removing the grout 204 in the spaces 205 between the tiles 133), with the belt 129 being washed and then returned to its cleaning of the tile surface 132. Downward pressure of the compression plate 134 on the belt 129 presses the belt 129 against the surface 132 of the tiles 133, enhancing the cleaning and contributing to propel the apparatus 100 forward.

Figure 14:
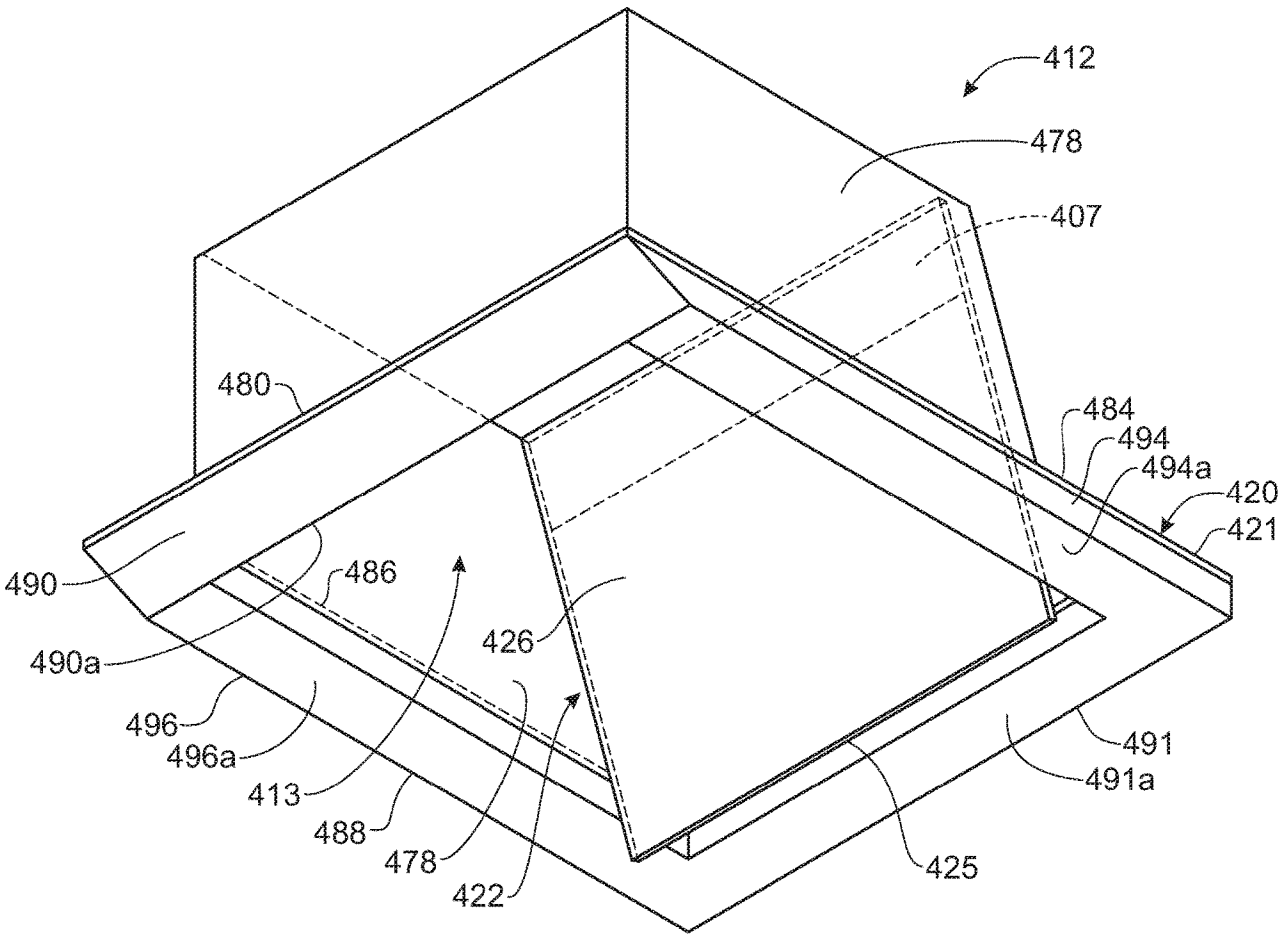
FIG. 14 shows a bottom front perspective view of a grout dispensing head in accordance with a second embodiment of the invention.

The illustration of FIG. 14 shows a grout dispensing head 412 in accordance with a second embodiment of the invention. Like features of the present grout dispensing head 412 and the grout dispensing head 212 of the previous embodiment are numbered the same except preceded by the numeral '4'. Unless expressly stated otherwise, the features of the previous embodiment apply to the present embodiment, and vice versa.

Similarly to the previous embodiment, the grout dispensing head 412 is arranged frontward of the grout removal member provided by the continuous belt 129. The grout dispensing head 412 is a hollow body which delimits an internal space 413 for receiving grout 204 from the grout tank 202 of the grout application system 200. A bottom frame 420 is provided in the grout dispensing head 412, the bottom frame 420 having a rectangular frame body 421 including a front portion 480, a rear portion 482, and opposite side portions 484, 486. A bottom flexible layer 488 is attached to the rectangular frame body 421 and includes a front portion 490 and opposite side portions 494, 496. Similarly to the previous embodiment, the flexible layer 488 is elastically-deformable (tending to recover its original non-deformed shape), and is preferably made of rubber foam. However, unlike the previous embodiment, the present flexible layer 488 further includes a rear portion 491, so that all four sides or portions 480, 482, 484 and 486 of the frame body 421 can rest on the outer surface 132 of the tiles 133 via the corresponding four portions 490, 491, 494 and 496 of the flexible layer 488. The four portions 490, 491, 494 and 496 of the flexible layer 488 include a respective bottom side or edge 490*a*, 491*a*, 494*a* and 496*a* intended to rest on the outer surface 132 of the tiles 133. The front portion 490 is beveled upward forwardly of its bottom edge 490*a*, to facilitate overcoming irregularities on the tiled floor as the apparatus moves forward when being used to clean grout.

Also similarly to the previous embodiment, the grout dispensing head 412 of the present embodiment includes a squeegee 422 arranged on a rear side of the internal space 413 of the grout dispensing head 412. The squeegee 422 is attached to a rear crossbeam 407 of the grout dispensing head 412 similarly to the previous embodiment, hanging downward from the rear crossbeam 407 and preferably at an angle. The squeegee 422 comprises a front rubber panel 426 attached to a rear metal panel 425. Similarly to the previous embodiment, the squeegee 422, and particularly the rubber panel 426, extends along the full width of the internal space 413, sealing against side walls 478 of the grout dispensing head 412, preferably along the full height of the internal space 413; this allows the rubber panel 426 to act as a barrier which prevents grout 204 from passing rearward therefrom and can push the grout 204 in the internal space 413 forward. Preferably, similarly to the previous embodiment, the metal panel 425 extends along the full width of the rubber panel 426. In some embodiments, the metal panel 425 extends to a bottom or distal end of the squeegee 422, similarly to the rubber panel 426.

Figure 15:
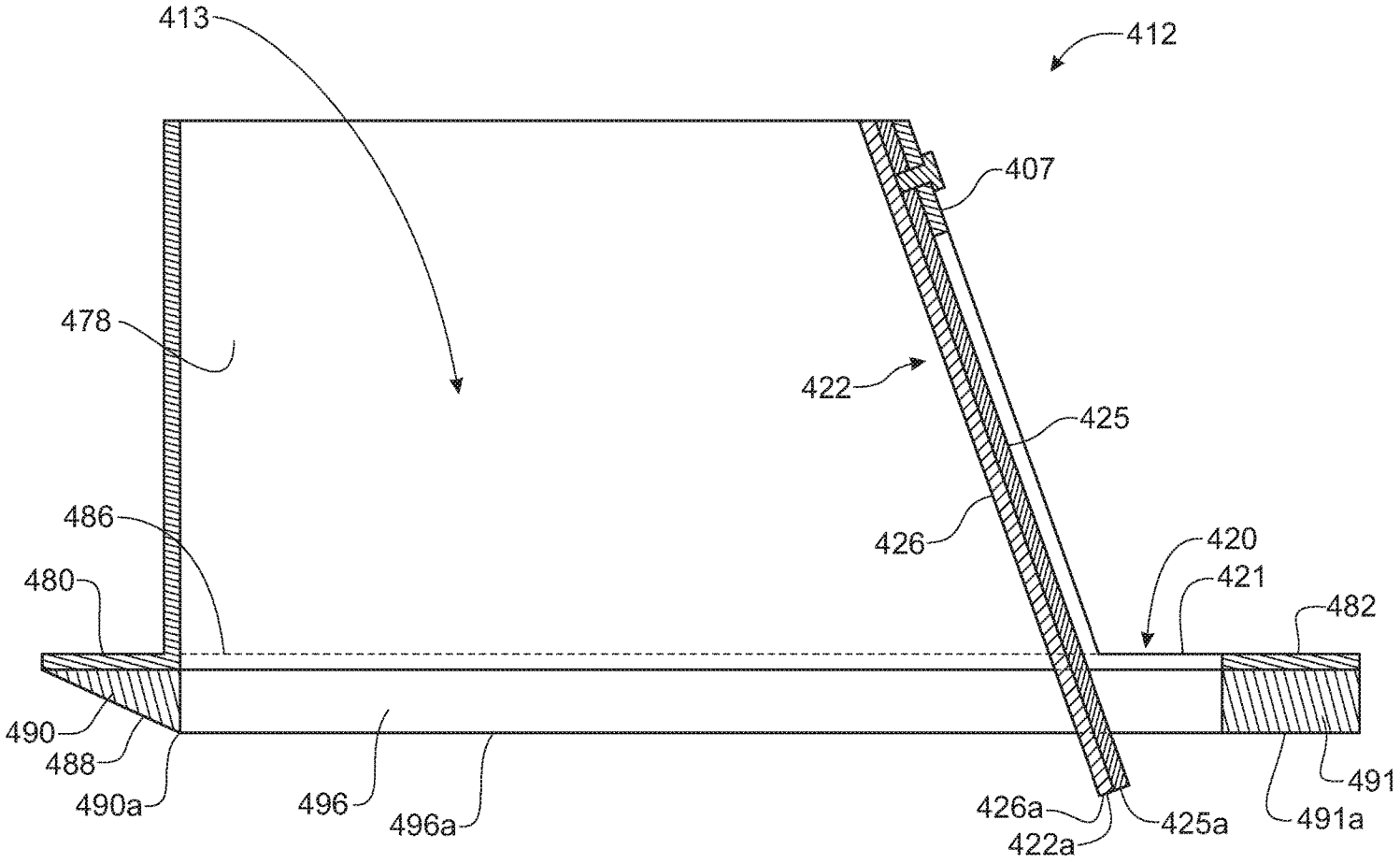
FIG. 15 shows a cross-sectional side elevation view of the grout dispensing head of FIG. 14, shown in a transport position.

The illustration of FIG. 15 shows the grout dispensing head 412 in a transport position similar to the transport position described with reference to FIG. 3. In the transport position, the grout dispensing head 412 and the grout removal member (belt 129) are elevated and spaced apart from the outer surface 132 of the tiles 133 and the apparatus is supported on the outer surface 132 of the tiles 133 by a set of wheels (transport wheels 166, 118), similarly to the configuration shown in FIG. 3. The present embodiment includes an additional feature consisting in that, in the transport position, the squeegee 422 is not deformed and extends outwardly from the flexible layer 488.

Figure 16:
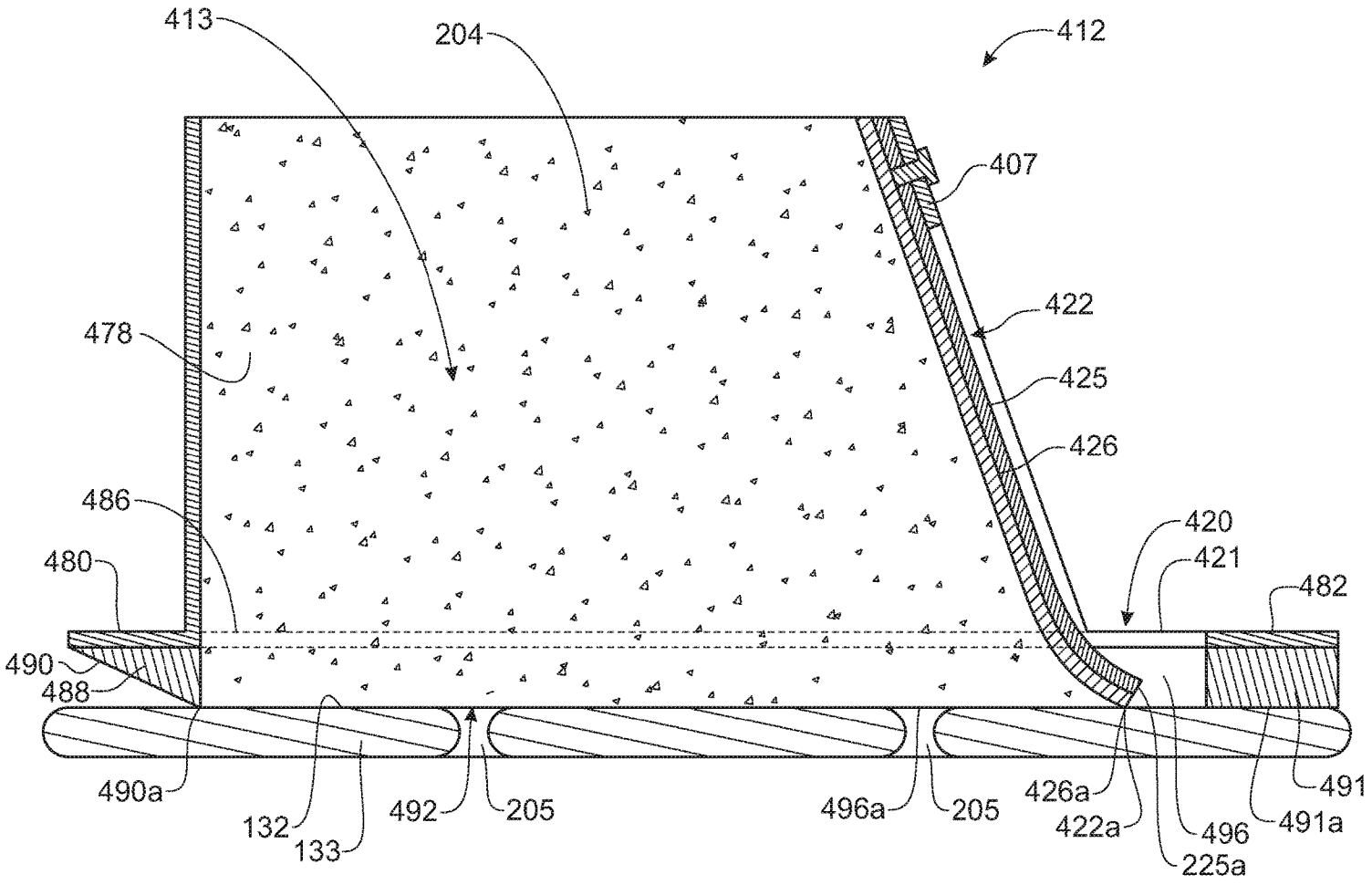
FIG. 16 shows a cross-sectional side elevation view of the grout dispensing head of FIG. 14, shown in a working position.

The illustration of FIG. 16 shows the grout dispensing head 412 in a working position similar to the working position described with reference to FIGS. 1 and 11. In this working position, the grout dispensing head 412, the grout removal member (belt 129) and auxiliary wheels 120, 122 contact the outer surface 132 of the tiles 133, while the transport wheels 116, 118 are in the air. As shown in FIG. 16, the flexible squeegee 422 has flexed rearward and a bottom or distal edge 422*a* of the squeegee 422 is provided by a bottom or distal edge 426*a* of the rubber panel 426; this distal edge 422*a* of the squeegee 422 rests on the outer surface 132 of the tiles 133, while a bottom or distal edge 425*a* of the metal panel 425 does not contact the outer surface 132 of the tiles 133. The bottom edges 490*a*, 494*a*, and 496*a* of the front and side portions 490, 494 and 496 of the flexible layer 488 of the bottom frame 420 and the distal edge 422*a* of the squeegee form an effective an outer edge of the grout dispensing head 412 which, in the working position, is planar (i.e. arranged on a same plane) and forms a closed, rectangular perimeter. This closed perimeter delimits and fully encircles an end opening 492 of the grout dispensing head 412, and is in communication with the internal space 413 of the grout dispensing head 412 for receiving grout 204 from the grout tank 202 and dispensing said grout 204 through the end opening 492 to a portion of the tiled floor delimited within the perimeter and facing the end opening 492. Thus, as the apparatus is operated to force grout 204 outward through the end opening 492, the grout 204 is applied to a confined area and can penetrate well into the spaces 205 between the tiles 132.

Also similarly to the previous embodiment, the apparatus in the working position is moved forward while applying the grout 204. When moved forward, the flexible squeegee 422 scrapes the outer surface 132 of the tiles 133 and sweeps excess grout forward, leaving grout within the spaces 205 substantially flush with the outer surface 132 of the tiles 133. As mentioned heretofore, the squeegee 422 of the present embodiment has flexed from an initial extended position (FIG. 15) to a deformed position (FIG. 16). In this deformed position, the squeegee 422 is tensioned and pushing outward to recover its extended position (FIG. 15), and is thus exerting a force on the outer surface 132 of the tiles 133 which improves the scraping and sealing of the squeegee 422 against the outer surface 132 of the tiles 133. In addition, the metal panel 425 of the squeegee 422 helps the squeegee to withstand the pressure of the grout 204 contained within the internal space 413 and push the grout 204 forward.

The above-described embodiment and method are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A grout installation system including an apparatus having:

a grout applying member, for applying grout to spaces between tiles comprised in a tiled area, the grout applying member comprising:

a grout tank having an internal space for storing grout, and a grout dispensing head having an internal space in communication with the internal space of the grout tank for receiving grout therefrom; and a grout removal member arranged rearward of the grout applying member, the grout removal member operable to remove grout from an outer surface of the tiles; wherein the apparatus is operable to adopt a working position in which an outer edge of the grout dispensing head rests against the outer surface of the tiles, and in which the outer edge of the grout dispensing head defines a closed and planar perimeter encircling and delimiting an end opening of the grout dispensing head, the end opening in communication with the internal space of the grout dispensing head for receiving grout from the grout tank and dispensing said grout through the end opening to a portion of the tiled area delimited by the perimeter; wherein the grout applying member further comprises a piston movable along the internal space of the grout tank and operable to force grout out of the internal space of the grout tank, into the internal space of the grout dispensing head, through the end opening of the grout dispensing head and into spaces between the tiles facing the end opening when said grout dispensing member is actuated.

2. The system of claim 1, wherein the grout applying member is positioned at a forward end of the apparatus.

3. The system of claim 1, wherein said grout dispensing head comprises a frame providing at least part of said outer edge of the grout dispensing head.

4. The system of claim 3, wherein said frame comprises an outer flexible, elastically-deformable layer providing said at least part of said outer edge of the grout dispensing head.

5. The system of claim 4, wherein said outer flexible, elastically-deformable layer is made of rubber foam.

6. The system of claim 1, wherein the grout dispensing head further includes a flexible squeegee delimiting a rear side of the internal space of the grout dispensing head, an edge of the squeegee providing a rear portion of the outer edge of the grout dispensing head, said squeegee configured to sweep grout off the outer surface of the tiles and into spaces between tiles as the apparatus moves forward.

7. The system of claim 6, wherein the flexible squeegee extends from opposite sidewalls of the grout dispensing head and seals the rear side of the internal space of the grout dispensing head.

8. The system of claim 6, wherein, when the apparatus is in said working position, the squeegee is deformed and tensioned and said edge of the squeegee is pushing outward from said outer opening.

9. The system of claim 8, wherein said grout dispensing head is configured to adopt a transport position in which said squeegee is not deformed and extends outwardly from said outer opening of the grout dispensing head.

10. The system of claim 6, wherein the squeegee comprises a rubber panel and a metal panel adjacent to one another.

11. The system of claim 10, wherein the rubber panel is made of rubber foam.

12. The system of claim 1, wherein the grout tank includes a pivotable handle engaged to a respective ratchet gear on left and right side walls of the grout tank.

13. The system of claim 12, wherein the pivotable handle of the grout tank is operable from a user-operable handle of the apparatus, located at a rear of the apparatus, via at least one cable connecting the pivotable handle of the grout tank to the user-operable handle of the apparatus.

14. The system of claim 1, wherein the apparatus is configured to adopt a transport position in which the grout dispensing head and the grout removal member are elevated and spaced apart from the outer surface of the tiles and in which the apparatus is supported on the outer surface of the tiles by a set of wheels.

15. The system of claim 1, wherein the grout removal member comprises:

a continuous belt having an outer flight arranged in a front-to-back, longitudinal direction and operable to rotate such that said outer flight moves rearward in the longitudinal direction, away from said grout applying member, wherein said continuous belt includes a spongy outer surface, and wherein the spongy outer surface of said outer flight of the continuous belt contacts the outer surface of the tiles; and a compression platen arranged inward of said bottom flight and in said front-to-back, longitudinal direction, the compression platen configured to press said spongy outer surface of said bottom flight of the continuous belt outwardly against the outer surface of the tiles when the apparatus is in the working position.

* * * * *